US007398566B1

(12) United States Patent
Merritt

(10) Patent No.: US 7,398,566 B1
(45) Date of Patent: Jul. 15, 2008

(54) FOLDAWAY BED FRAMES AND SPRING SUPPORTS

(76) Inventor: Bernard Merritt, 10440 Button Willow Dr., Las Vegas, NV (US) 89134-7344

( * ) Notice: Subject to any disclaimer, the term of this patent is extended or adjusted under 35 U.S.C. 154(b) by 24 days.

(21) Appl. No.: 11/538,724

(22) Filed: Oct. 4, 2006

Related U.S. Application Data

(60) Provisional application No. 60/596,572, filed on Oct. 4, 2005.

(51) Int. Cl.
*A47C 19/12* (2006.01)

(52) U.S. Cl. ..... 5/136; 5/160; 5/164.1

(58) Field of Classification Search ..... 5/136, 5/159.1, 160, 162, 164.1, 170
See application file for complete search history.

(56) References Cited

U.S. PATENT DOCUMENTS

| | | | | |
|---|---|---|---|---|
| 1,080,867 A | | 12/1913 | Tracy | |
| 1,121,789 A | * | 12/1914 | Bonner | 5/164.1 |
| 1,262,706 A | | 4/1918 | Sisbower | |
| 1,368,205 A | | 2/1921 | Bell | |
| 1,380,502 A | * | 6/1921 | Sinclair | 5/164.1 |
| 1,714,878 A | | 5/1929 | Kita | |
| 3,121,237 A | | 2/1964 | Brindisi | |
| 3,550,167 A | | 12/1970 | Bennett | |
| 4,366,586 A | | 1/1983 | Teague | |
| 4,370,766 A | * | 2/1983 | Teague, Jr. | 5/133 |
| 4,679,261 A | | 7/1987 | Stanley | |
| 5,036,558 A | * | 8/1991 | Lameka et al. | 5/136 |
| 5,446,932 A | * | 9/1995 | Voorhis | 5/137 |
| 5,652,978 A | | 8/1997 | Wiig | |
| 6,477,726 B2 | | 11/2002 | Hernandez | |
| 6,574,807 B1 | | 6/2003 | Gonzalez | |

* cited by examiner

*Primary Examiner*—Michael Trettel
(74) *Attorney, Agent, or Firm*—Kenehan & Lambertsen, Ltd.; John C. Lambertsen

(57) ABSTRACT

A folding bed frame utilizes a spring support bracket that is located intermediate a bed support frame and a mattress support frame. Separate pairs of tensioning springs attach the spring support bracket to the bed support frame and to the mattress support frame. This tiered spring arrangement provides an enhanced counterweighting force to the mattress support frame, assisting a user when raising or lowering the bed. Additionally, a hanger is attached to a rear surface of a front panel to assist in the proper positioning of the panel prior to its attachment to the mattress support frame.

9 Claims, 5 Drawing Sheets

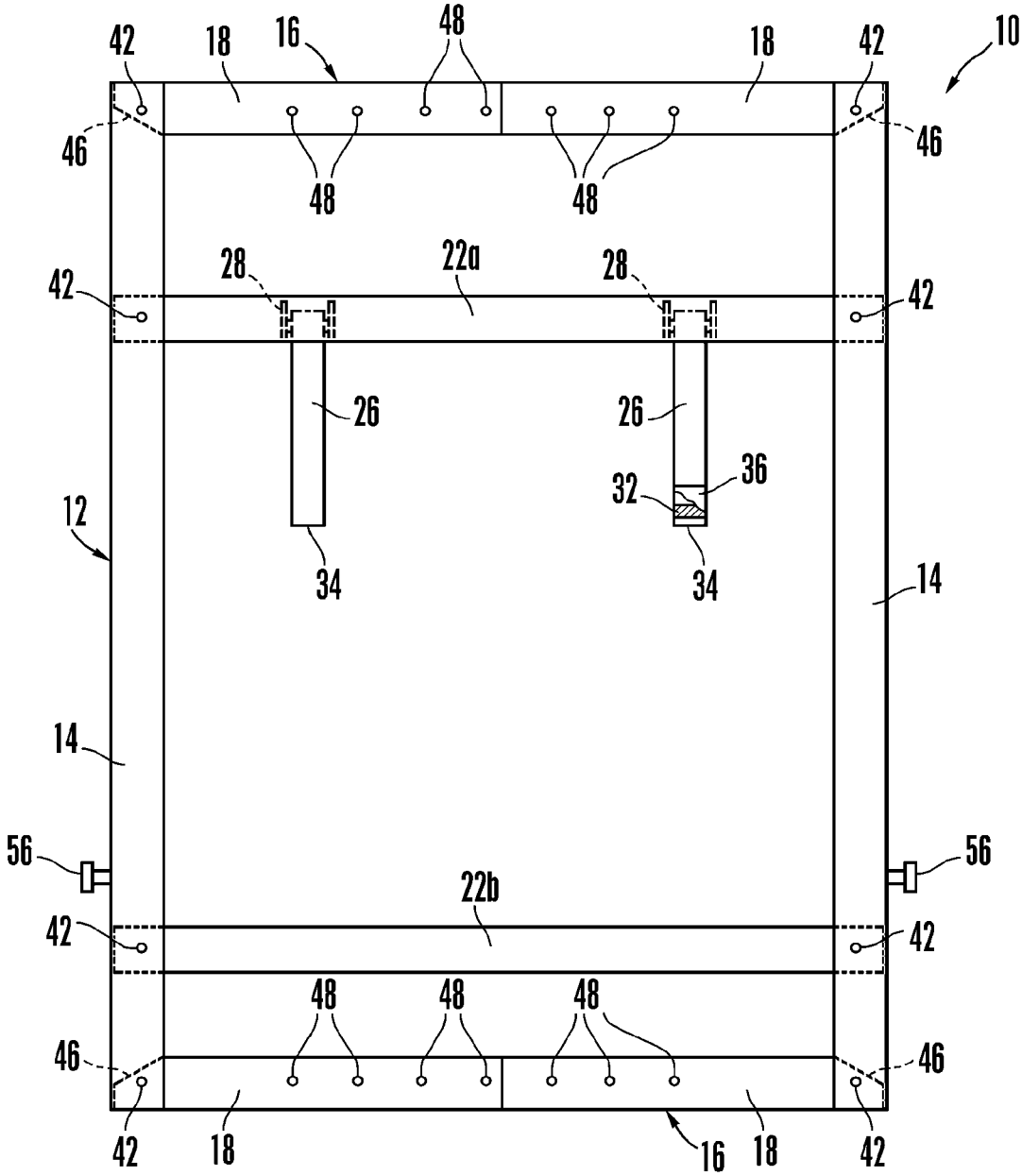
Figure 1
Figure 2
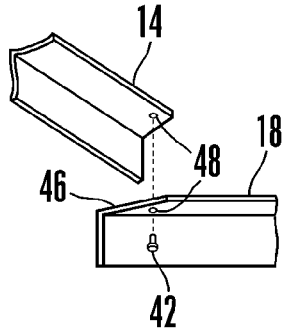

FOLDAWAY BED FRAMES AND SPRING SUPPORTS

CROSS-REFERENCE TO RELATED APPLICATION

This application claims the benefit of U.S. Provisional Application Ser. No. 60/596,572, filed Oct. 4, 2005.

FIELD OF THE INVENTION

The present invention relates to beds and, more particularly, to beds that fold into a wall or storage cabinet. More specifically, the present invention relates to a folding front panel bed having improvements in its spring support and manner of panel attachment.

DESCRIPTION OF THE PRIOR ART

Known as an idea whose time has come, gone, and come again, the Murphy bed (also known as wall-beds, door and foldaway beds) was invented in California by William K. Murphy around the turn of the last century. By 1927 the Murphy In the Door Bed Co. was a $30 million a year business with factories in San Francisco, Chicago, and New York. Amazingly, the company lasted until the early 1980's; however, by the end of that decade, a court decided that the "Murphy" trademark could be used by any company to describe a foldaway bed.

Instead of fading into history like a buggy whip, in recent years the foldaway bed has enjoyed increasing popularity. As greater numbers of retirees sell the family home and move into smaller quarters, the versatility of a foldaway has gained renewed appreciation. Even in larger houses the popularity of multiple use rooms has provided another venue for the foldaway bed. Housed in freestanding cabinets and flanked by bookcases, the foldaway bed is perfect for home offices that must also function as an extra bedroom.

Foldaway bed units can be mounted to the floor or secured to the wall located behind the bed. All foldaway beds follow the original Murphy bed design, using a series of high-tension balancing springs that function as a counterweight to the steel bed frame to which they are attached.

In a traditional Murphy bed the bed legs are pushed into position as the bed lowers by control rods connecting to the legs on each side of the bed. The rods are fabricated out of a thin metal sheet, and the manner of their connection to the legs makes them susceptible to damage due to jamming when the bed is raised or lowered. Damage can also occur as the result of inadvertent impacts to the lowered leg, such as by a user's foot when making the bed, by vacuum cleaners when cleaning, and the like. Any of these impact forces can result in a bending of the control rod, causing the legs to no longer correctly operate. Control rod replacement is often the only remedy, at considerable inconvenience and expense to both the customer and to the dealer.

When placed in an upright, stored position the majority of mattress weight is intended to be supported by the steel bed frame—provided the user remembers to utilize the mattress belt (which holds the mattress tightly to the frame). If the user fails to use the belt, the majority of mattress weight is instead applied to a head frame support bracket. Any dynamic loading is likely to prove too much, causing the support bracket to bend. The compactness of bed design means that very little frame bending can be tolerated before the bed no longer properly rotates into its stored position. Replacement of the head frame is then required.

Traditionally, the steel bed frame is a welded unit that is configured for a specific size bed (for example, twin, standard, queen or king). Such size-specific frames require special shipping arrangements and occupy valuable warehouse space prior to their sale. The majority of dealers are unable and/or unwilling to maintain adequate inventory levels for each of the bed frame sizes.

Many of today's foldaway beds fit within a storage cabinet, enabling the bed to be completely hidden from view when stored. The cabinets can be provided with doors to enclose the stored bed within the cabinet, opening only when the bed is to be used. A popular alternative design features the use of a face panel attached to the underside of the bed, which effectively forms the cabinet "door" when the bed is upright and received within the cabinet.

As mentioned above, Murphy beds have utilized pre-installed sets of high-tension balancing springs to minimize the amount of "bed-weight" a user must support when raising and lowering the bed. When using such pre-set units a panel bed designer must take great care when making the face panels to avoid exceeding the load factor for the springs. Such panels are frequently fabricated out of wood, and if care is not taken when designing the panel, it is easy to exceed the intended panel weight.

When the foldaway bed is rotated out of the cabinet and down into its lowered, functional position, the head of the bed lies somewhat separated from the wall of the cabinet. Traditional beds utilize a headboard to frame the head end of the bed; the rotational bed frame movement has prevented the use of a headboard in foldaway beds.

SUMMARY OF THE INVENTION

It is an aspect of the present invention to provide legs that operate independently of any mechanical rods or connections. Utilizing a pivot connection and gravity to correctly position the legs when the bed is lowered avoids the complexity of the prior design as well as its susceptibility to damage during use. This manner of operation also permits the positioning of the legs further underneath the bed, lessening the opportunity for users to inadvertently strike the legs after the bed is lowered.

Another aspect of the present invention provides a collapsible bed frame that may be assembled on-site and in varied widths to accommodate multiple bed sizes. The manufacturer can rely upon "retail" shipping methods, while the foldaway bed sellers need set aside significantly less storage space. Sellers can obtain more reliable and less expensive shipments of bed frames, as required by customer demand. In addition, only a small inventory provides the seller the ability to offer multiple bed frame sizes to meet the sometime unpredictable demand of its customers.

Another aspect of the present invention enhances the mechanical advantage of the foldaway bed tension springs by alternative base frame designs. In a first design the rotational pivot is moved inward from the face of the frame. Such pivot relocation provides a greater mechanical advantage to the tension spring connection with the bed frame, enabling the use of fewer springs to accomplish the needed counterweight action.

A second design utilizes a two-tiered bracket and spring arrangement. Springs can easily be added to balance the load factor if heavier beds or front panels are used. Additionally, the superior mechanical advantage provided by the double bracket design enables the use of much heavier front panels when designing foldaway bed sets.

Additional aspects of the present invention will become apparent from the following description, taken in conjunction with the accompanying drawings.

BRIEF DESCRIPTION OF THE DRAWINGS

FIG. 1 is a plan view of a bed frame with portions shown in phantom and portions broken away.

FIG. 2 is an exploded partial perspective view of a pair of bed frame cross-support arms.

DETAILED DESCRIPTION OF THE PREFERRED EMBODIMENTS

Figure 3:
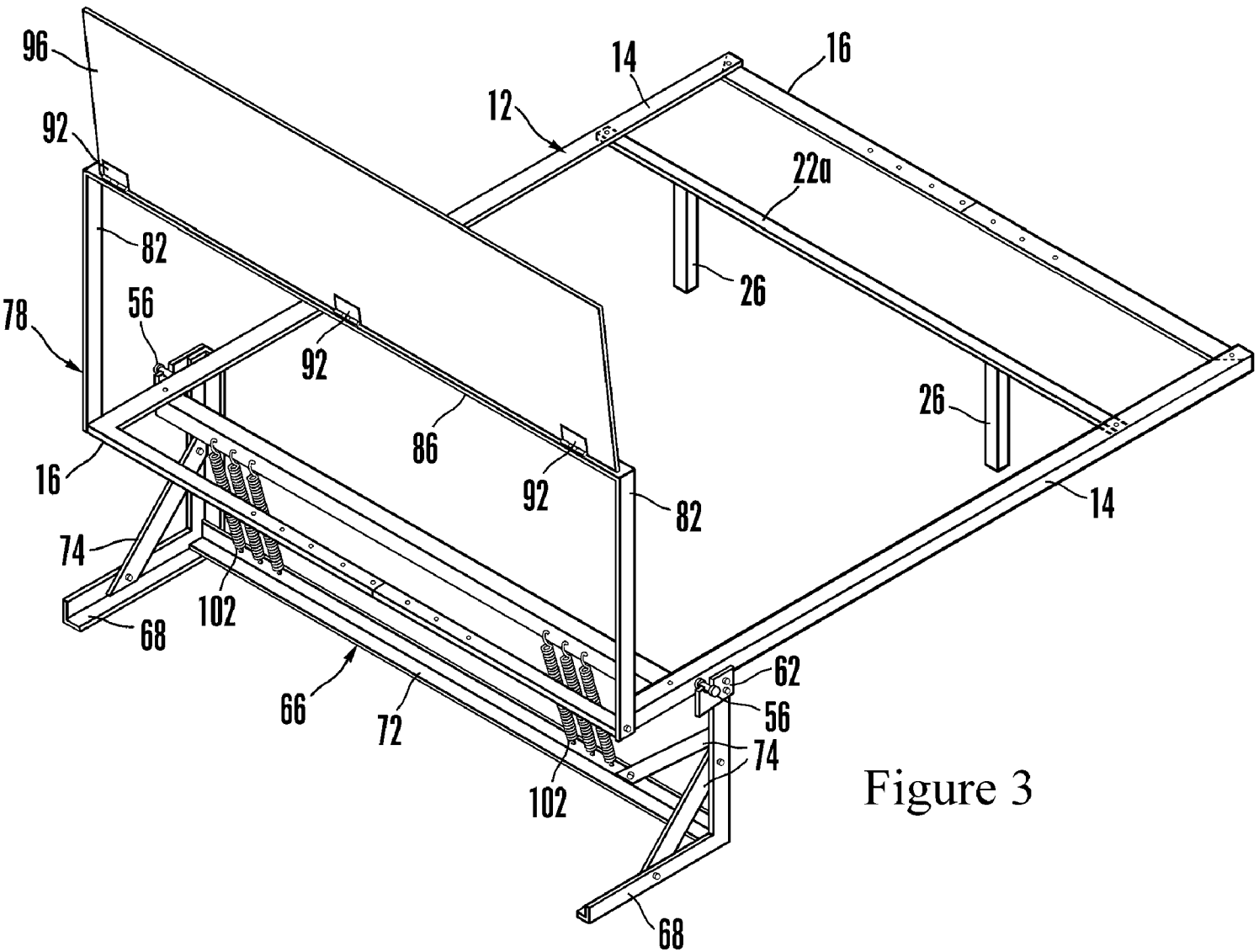
FIG. 3 is perspective view of a foldaway bed frame mounted on a bed support frame, the bed frame in a lowered position.

Reference is now made to the drawings wherein like numerals refer to like parts throughout. In FIG. 1, a bed frame 10 is constructed in a collapsible manner to greatly simplify its manner of shipment to wholesalers as well as minimize inventory concerns. Typically fabricated from angle irons of cold rolled steel, the bed frame 10 includes a mattress support frame 12 that consists of a pair of longitudinal support rails 14 attached to one another by a pair of cross-support rails 16. Each of the cross-support rails consist of a pair of support arms 18 that respectively extend from an attachment location on the longitudinal support rails 14 to a central attachment location that connects the pair of support arms 18.

Additional strengthening of the mattress support frame 12 is provided by solid cross-frame members 22. In addition to providing greater rigidity to the mattress support frame 12, the cross-frame members 22 can additionally provide support for other bed frame attachments. In the case of FIG. 1, a first cross-frame support 22*a* also functions as an attachment member for a pair of bed legs 26.

Figure 5:
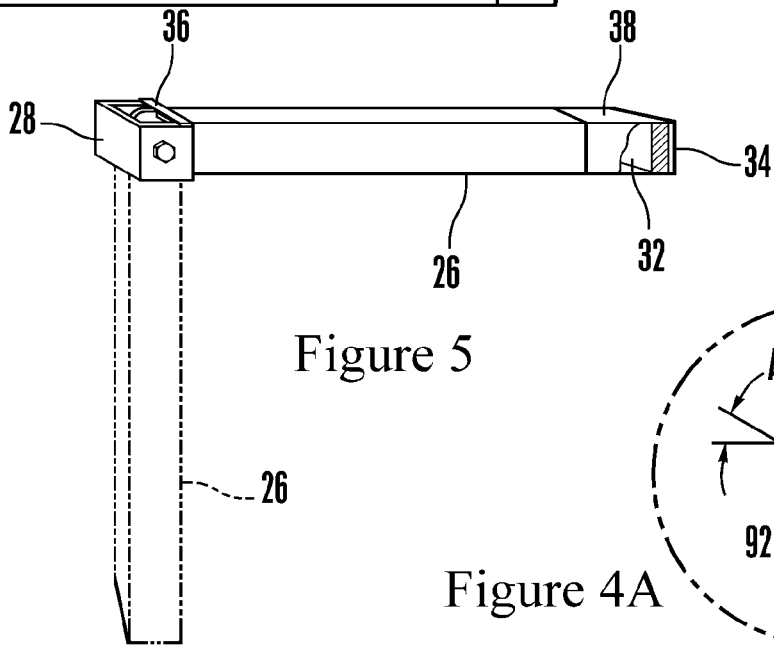
FIG. 5 is a perspective view of a bed leg, with portions in phantom and portions broken away.

Each of the bed legs 26 is pivotally attached to a separate attachment bracket 28 that is in turn attached to the cross-frame support 22*a*. As the bed frame 10 rotates between its stored and functional positions (also see FIG. 5), the pair of bed legs 26 likewise rotates between a position co-planar with the bed frame 10 and one that is substantially perpendicular thereto—the latter position enables their use to support the bed frame 10.

The bed legs 26 must reliably deploy, and to insure they properly pivot, each of the bed legs 26 is provided a weight 32 located adjacent a foot 34 thereof. To prevent their over-extension/rotation, a stop 36 is attached to each of the bed leg attachment brackets 28. Additionally, a protective footing 38 is also preferably provided to avoid the inadvertent marring of floor surfaces.

The primary benefit of the collapsible bed frame 10 relates to the ability to ship and store the bed frame 10 in a collapsed state, which occupies considerably less volume than in the traditional welded steel frame. The cross-support rails 16 and the solid cross-frame members 22 are attached to the longitudinal support rails 14 using a plurality of bed frame fasteners 42.

An angled cut-out 46 is formed at each of the attachment ends of the support arms 18 to enable rotation of the support arm 18 upon loosening the bed frame fastener 42. In this manner the support arms 18 can be shipped in a position substantially parallel to the longitudinal support rail 14 to which it is attached. Upon assembly of the bed frame 10, the bed frame fasteners 42 are loosened to permit rotation of the support arms 18 from their stored position parallel to the support rail 14 to a position that is substantially perpendicular thereto.

A plurality of support arm attachment apertures 48 are formed in the support arms 18, permitting the connection between opposed support arms 18 to be of different widths, reflecting the desires of the customer—for example, twin, double, and queen widths. As is best understood with reference to FIG. 2, two support arms 18 are moved into a desired position such that a desired two attachment apertures 48 are brought into alignment, permitting a support arm fastener 52 to be received therein, attaching the support arms 18 together.

Returning momentarily to FIG. 1, a pair of bed frame pivots 56 are attached to the longitudinal support rails 14, each to a separate rail and at substantially the same longitudinal position relative to one another. Turning now to FIG. 3, the pair of bed frame pivots 56 are received by a corresponding pair of pivot receiving brackets 62 that are each attached to a bed support frame 66.

To provide both support and stability the bed support frame 66 is assembled out of a pair of lateral base brackets 68 attached to a transverse support rail 72. A plurality of support braces 74 reinforce the vertical member of each of the lateral base brackets 68, enhancing both lateral and fore-aft stability.

A mattress support head frame 78 is attached to the bed frame 10 and includes a pair of side supports 82 attached to and connected by a top support 86. The side supports 82 are also attached to longitudinal support rails 14, forming a substantially rectangular construction located at the head of the bed frame 10. Additional support is provided by a stiffening brace 88 that is attached to and extends between the pair of side supports 82, as well as a pair of head frame support braces 90 that are each attached to and extend between the side supports 82 and the longitudinal support rails 14.

Although not shown in the Figures, when the bed frame 10 is rotated to its vertical, stored position, a substantial portion of the mattress weight is applied to the mattress support head frame 78. Its multi-member construction better distributes the mattress-generated forces involved, lessoning the opportunity for destructive bending forces causing damage to the bed frame 10 or other components thereof.

Figure 4:
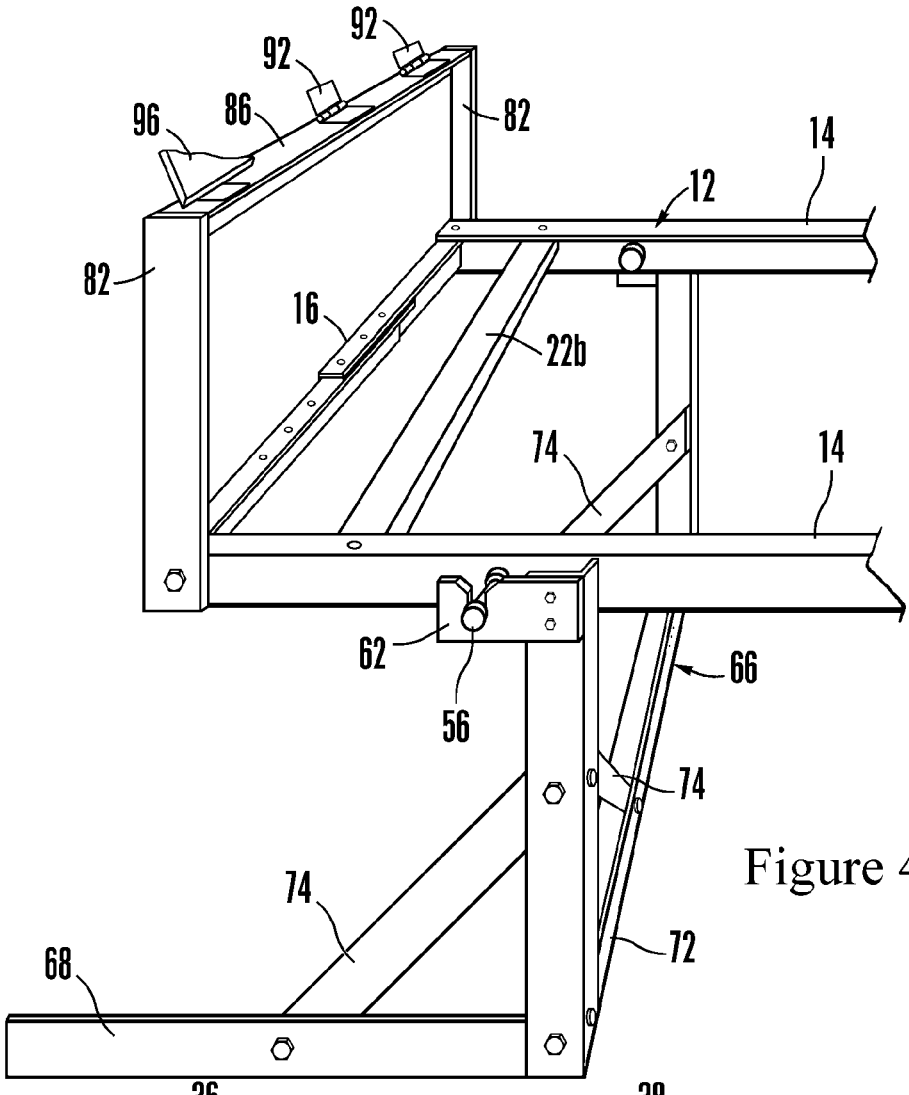
FIG. 4 is enlarged, partial perspective view of the foldaway bed frame of FIG. 3 as received upon the bed support frame.
Figure 4A:
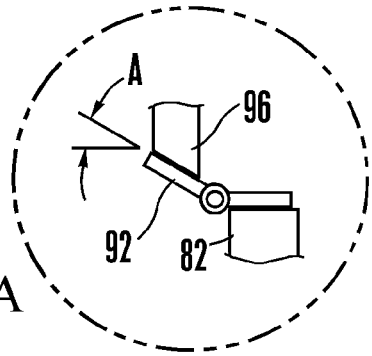
FIG. 4A is an enlarged side elevation view of a hinge used to attach a headboard to a mattress support head frame.

A plurality of hinges 92 are used to attach a headboard 96 to a top surface of the top support 86. Utilization of the hinges 92, such as butt hinges, enables the headboard 96 to alter its angular position relative to the mattress support head frame 78 as the bed frame 10 is rotated between its stored and its functional positions. Additionally, as is shown in FIG. 4A, to insure the proper movement of the headboard as the bed frame 10 is rotated, the attachment surface of the headboard 96 is at an angle A. While 30 degrees is presently preferred, other angles are undoubtedly appropriate and the present invention should not be viewed as in any way limited to a certain angle measurement.

Such rotation of the bed frame 10 occurs about the pivots 56, with the weight of the bed frame 10 and a mattress (not shown) counteracted by a plurality of tension springs 102.

Extending between attachment locations on the transverse support rail 72 and the head cross-frame member 22*b*, the tension springs 102 lessen the perceived weight of the bed as it rotates between the storage and the functional positions.

The efficiency of the tension springs 102 is further enhanced by the location of the pivot receiving support bracket 62. Instead of the traditional pivot mounting at or forward of the bed support frame 66, as is best shown with reference to FIG. 4 the pivot is mounted inward—approximately 1½ inches. This pivot placement results in greater tension being applied to the tension springs 102. As a result, the tension springs 102 operate more efficiently, and fewer springs are required.

Figures 6, 7:
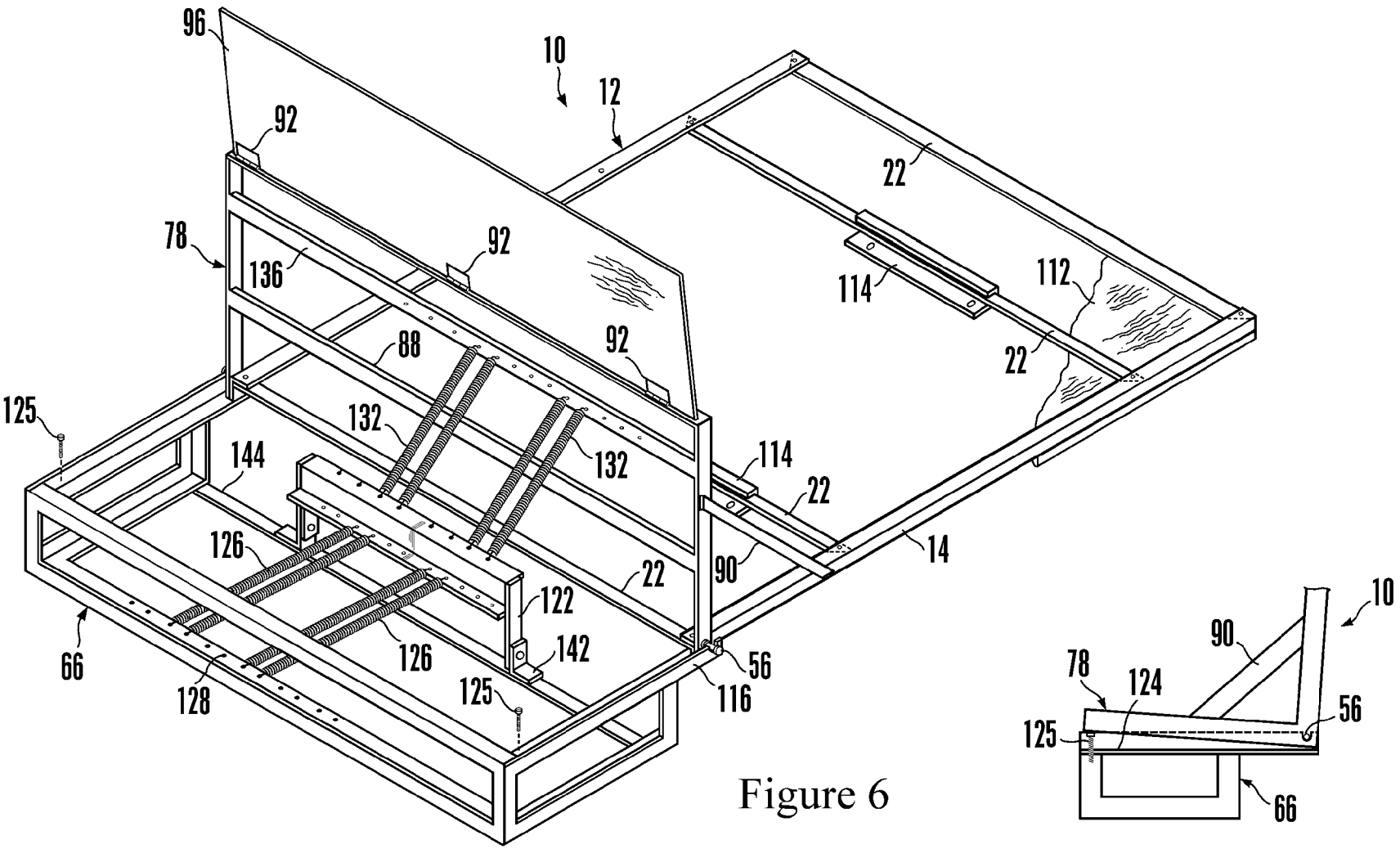
FIG. 6 is a partial perspective view of a foldaway bed frame having a front panel mounted thereto as received upon a bed support frame having a multiple tiered spring support.
FIG. 7 is a partial side elevation view of a bed frame received by a bed support frame.

Another type of foldaway bed, shown in FIG. 6, includes a front panel 112, normally fabricated of wood, which is attached to the bed frame 10 using a pair of J-bars 114. Fabricated out of thin metal, the J-bars 114 are attached to the front panel 112 utilizing a plurality of J-bar fasteners 114*a*. At an appropriate time, the attachment of the front panel 112 to the bed frame 10 is initiated by utilizing the J-bars 114 to slip over the cross-frame members 22, which properly positions the front panel 112 for its subsequent, physical attachment to the bed frame 10 utilizing apertures formed in the cross-frame members 22 (not shown) and fasteners, such as wood screws.

The front panel 112 adds considerable weight to the bed frame 10, necessitating some different design features. The bed frame 10 makes use of solid cross-frame members to increase its ability to support the greater loading. In addition, since the front panel 112 is in fact the front face of the bed, no bed legs are used to support the bed frame 10 when in the lowered functional position.

Instead the bed support frame 66 is lowered in height, and the pivot 56 is supported by an extended pivot support bracket 116. In a presently preferred embodiment, the support frame is approximately 3½ inches above the support surface and the extended pivot support bracket 116 extends out from the bed support frame by the same, approximately 3½ inches.

Such positioning does not provide the mechanical advantage as does the inward pivot location previously discussed. A tiered spring arrangement is shown in FIG. 6, having a spring support bracket 122 located within the bed support frame 66. A first set of tensioning springs 126 is attached to the spring support bracket 122 and extends back to bed support frame spring bar 128. A second set of tensioning springs 132 extends from the spring support bracket 122 to a head frame spring bar 136.

For placement in a storage position, the bed frame 14 rotates about the bed frame pivots 56 until the mattress support head frame 78 lies against a support surface 124 on the bed support frame 66—see FIG. 7. A pair of adjustment bolts 125 project from the support surface 124, and are utilized to adjust the positioning of the bed frame 14 to achieve a substantially 90 degree position.

To match the rotational movement of the bed frame 14, the spring support bracket 122 is pivotally attached to a pair of base mounts 142, which are in turn attached to a base mounting member 144 that is attached and extends between the lateral members of the bed support frame 66. The primary function of the base mounting member 144 is to ensure the proper location of the spring support bracket 122 relative to the bed support frame spring bar 128.

Figure 8:
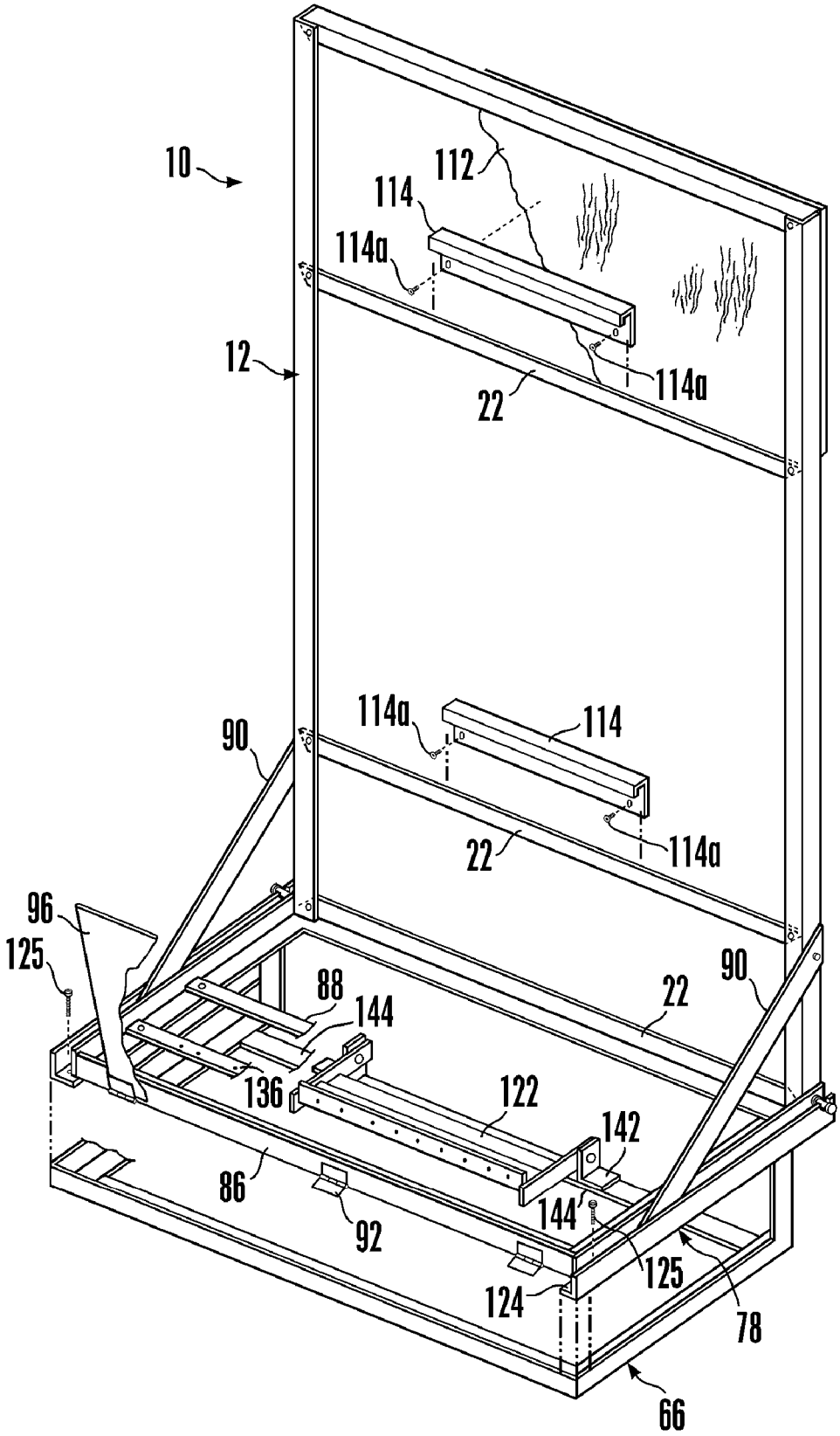
FIG. 8 is a partial perspective view of the foldaway bed frame of FIG. 6 in a vertical, stored position.

As is best shown with reference to FIG. 8, upon rotating the bed frame 10 to a vertical, stored position, the spring tension is substantially relieved, particularly with respect to the second set of tensioning springs 132 (both sets of springs have been removed from FIG. 8 for purposes of clarity). Such lessening of tension in the second set of springs 132 enables the tension remaining in the first set of tensioning springs 126 to cause rotation of the spring support bracket 122 towards the bed support frame spring bar 128.

Returning to FIG. 6, when the bed frame 10 is rotated from storage to the functional position, the just-discussed spring operation reverses to effectively provide proportional counterweight support. The initial support is provided by the second set of tensioning springs 132, and as the bed frame rotates further out, the first set of tensioning springs 126 provide the additional counterweight forces required. This tiered spring structure also permits easy spring adjustment when the design of the front panel 112 results in either greater or lesser weight factors.

The invention may be embodied in other specific forms without departing from its spirit or essential characteristics. The described embodiments are to be considered in all respects only as illustrative and not restrictive. The scope of the invention is therefore indicated by the appended claims rather than by the foregoing description. All changes which come within the meaning and range of equivalency of the claims are to be embraced within that scope.

I claim:

1. A folding bed frame comprising:

a bed support frame, said bed support frame having a pair of bed frame pivots formed therein;

a mattress support frame received by said pair of bed frame pivots;

a support bracket intermediately located between and sequentially attached to said bed support frame and said mattress support frame in a manner communicating a biasing force to both said bed support frame and said mattress support frame, wherein at least a double pair of tension springs extend between and are attached to said support bracket and said mattress support frame and wherein at least a double pair of tension springs extend between and are attached to said support bracket and said bed support frame; and a base mount rotatably attached to said support bracket, wherein said support bracket rotates to a collapsed position when said mattress support frame pivots to a raised position and said support bracket rotates to an erect position when said mattress support frame pivots to a lowered position.

2. A foldaway bed comprising:

a bed support frame;

a mattress support frame rotatably received by said bed support frame, said mattress support frame comprising in part a pair of longitudinal support rails and a plurality of cross-frame members attached thereto and extending therebetween; and a front panel attached to said mattress support frame, wherein a hanger is attached to a back surface of said front panel and said hanger is slidably received upon one of said plurality of cross-frame members.

3. The foldaway bed as defined in claim 2, wherein a pair of hangers are each separately attached to said back surface of said front panel, each of said hangers is slidably received upon a separate one of said plurality of cross-frame members.

4. The foldaway bed as defined in claim 3, and further comprising a plurality of fasteners, each fixedly attaching said front panel to said mattress support frame.

5. The foldaway bed as defined in claim 4, wherein each of said plurality of fasteners is received by one of said cross-frame members and extends to a point of attachment with said front panel, securing same against said cross-frame member.

6. The foldaway bed as defined in claim 4, wherein said hanger comprises a j-bar.

7. A method of attaching a front panel toe a mattress support frame of a foldaway bed, comprising:

attaching a hanger strip to a back surface of said front panel;

hooking said hanger strip and attached front panel upon a cross-frame member of said mattress support frame;

moving said hanger strip along said cross-frame member to achieve a desired lateral position of said front panel relative to said mattress support frame; and attaching said front panel to said mattress support frame after achieving said desired lateral position.

8. A method of attaching a front panel as described in claim 7, wherein said hanger strip comprises a j-bar.

9. A method of attaching a front panel as described in claim 7, wherein a plurality of fasteners are used to attach said front panel to said mattress support frame.

* * * * *